United States Patent [19]

Bell

[11] Patent Number: 4,466,393

[45] Date of Patent: Aug. 21, 1984

[54] THERMAL SWITCH-OPERATED GLOW PLUG CONTROL DEVICE FOR DIESEL ENGINES

[75] Inventor: Lon E. Bell, Altadena, Calif.

[73] Assignee: Technar Incorporated, Arcadia, Calif.

[21] Appl. No.: 568,280

[22] Filed: Jan. 4, 1984

Related U.S. Application Data

[63] Continuation of Ser. No. 317,121, Nov. 2, 1981, abandoned.

[51] Int. Cl.[3] ..... F02N 17/00

[52] U.S. Cl. ..... 123/179 H; 123/179 B; 123/145 A; 219/494; 219/510

[58] Field of Search ..... 123/179 H, 145 A, 179 B; 219/492, 494, 509, 510, 511

[56] References Cited

U.S. PATENT DOCUMENTS

| | | | |
|---|---|---|---|
| 3,675,033 | 7/1972 | Richard et al. | 123/145 A |
| 4,075,998 | 2/1978 | Krauss et al. | 123/179 H |
| 4,177,785 | 12/1979 | Sundeen | 123/179 H |
| 4,207,853 | 6/1980 | Phillips | 123/179 H |
| 4,261,309 | 4/1981 | Biondi | 123/145 A |
| 4,300,491 | 11/1981 | Hara et al. | 123/179 H |
| 4,312,307 | 1/1982 | Cooper | 123/145 A |
| 4,337,389 | 6/1982 | Bell | 123/179 H |
| 4,413,174 | 11/1983 | Tuig | 123/179 H |

FOREIGN PATENT DOCUMENTS

| | | | |
|---|---|---|---|
| 1954630 | 5/1970 | Fed. Rep. of Germany | 123/179 H |
| 2225662 | 12/1973 | Fed. Rep. of Germany | 123/179 H |
| 2323485 | 11/1974 | Fed. Rep. of Germany | 123/179 H |
| 1299589 | 12/1972 | United Kingdom | 123/179 BG |

*Primary Examiner*—Parshotam S. Lall

*Attorney, Agent, or Firm*—Christie, Parker & Hale

[57] ABSTRACT

A glow plug control circuit uses two normally closed thermally actuated switches in series with a power relay and a timer switch across the battery when the ignition switch is turned on; the power relay connects the glow plugs to the battery. At least one of the two switches cycles on and off to limit the temperature of the glow plugs. Another normally closed thermally operated switch has a heating element in series with the glow plugs for turning off a lamp after the glow plugs are energized for a predetermined time. If one or more of the glow plugs are open-circuited, the lamp is cycled on and off with the cycling on and off of current through the glow plugs by the power relay, to signal a fault condition.

11 Claims, 4 Drawing Figures

THERMAL SWITCH-OPERATED GLOW PLUG CONTROL DEVICE FOR DIESEL ENGINES

CROSS-REFERENCE TO RELATED APPLICATIONS

This is a continuation of application Ser. No. 06/317,121 filed Nov. 2, 1981, now abandoned.

FIELD OF THE INVENTION

This invention relates to glow plug control circuits for diesel engines, and more particularly, to a control circuit using thermal switches.

BACKGROUND OF THE INVENTION

In my copending application Ser. No. 153,723, now U.S. Pat. No. 4,337,389 filed May 27, 1980, entitled "Glow Plug Control Device for Diesel Engines", there is described a thermally operated controller for a glow plug. The controller uses a thermally operated switch that is the thermal analog of the glow plugs to cycle the glow plugs on and off while maintaining the temperature of the glow plugs at a maximum safe operating level. A control circuit used in conjunction with the controller is described in U.S. Pat. No. 4,177,785. This arrangement requires a thermally operated circuit breaker that must be carefully designed to have a longer time delay than the controller in switching off power to the glow plugs and yet have a resistance that is less than the heater of the controller. In practice this imposes design limitations on the two switches that are very difficult to meet over a large ambient temperature operating range, so that at some ambient temperature, the circuit breaker may take too long to break the circuit to protect the plugs, while at some other ambient temperature, the circuit breaker may act before the controller to interrupt current to the glow plugs.

SUMMARY OF THE INVENTION

The present invention provides a thermally operated glow plug control circuit which is not only more simple and less expensive to manufacture and install, but also provides several features not found in the prior art. Thus the present invention provides a control circuit which eliminates the circuit breaker and instead uses two bimetal controllers in series for controlling the temperature of the glow plugs. Either one of the controllers operates to cycle the glow plugs on and off to limit the temperature of the glow plugs. Therefore, failure of either controller to interrupt current to the glow plugs is overcome by operation of the other controller. The two controllers do not need to track over the full operating range as long as either one of the controllers operates within the required tolerances.

Both controllers utilize bimetal elements which are heated by current that passes through the coil of the power relay controlling the glow plugs. This provides a self-protection feature in that an open-circuit condition in either heater interrupts current to the coil of the power relay.

Finally, a "WAIT/FAULT" light is controlled by a thermal switch in which the heating element of the switch is connected in series with the glow plugs. Thus if the current through the glow plugs changes because one or more of the glow plugs is open-circuited, the thermal switch will not turn off the light and the light will cycle on and off with the power relay and glow plugs, signaling a "FAULT" condition.

These and other advantages of the present invention are achieved by providing a glow plug control circuit in which a pair of thermally operated normally closed switches are connected in series with the coil of a power relay that switches power on and off to the glow plugs. A thermal switch having a heating element connected in series with the glow plugs operates a lamp which turns off when the glow plugs are fully heated. If some predetermined number of glow plugs are open-circuited, the heater will not open the thermal switch and the lamp will stay on, but is then cycled on and off with the glow plugs by the power relay, indicating a FAULT condition.

BRIEF DESCRIPTION OF THE DRAWINGS

These and other advantages of the present invention may be better understood by reference to the accompanying drawings, wherein.

DETAILED DESCRIPTION

Figure 1:
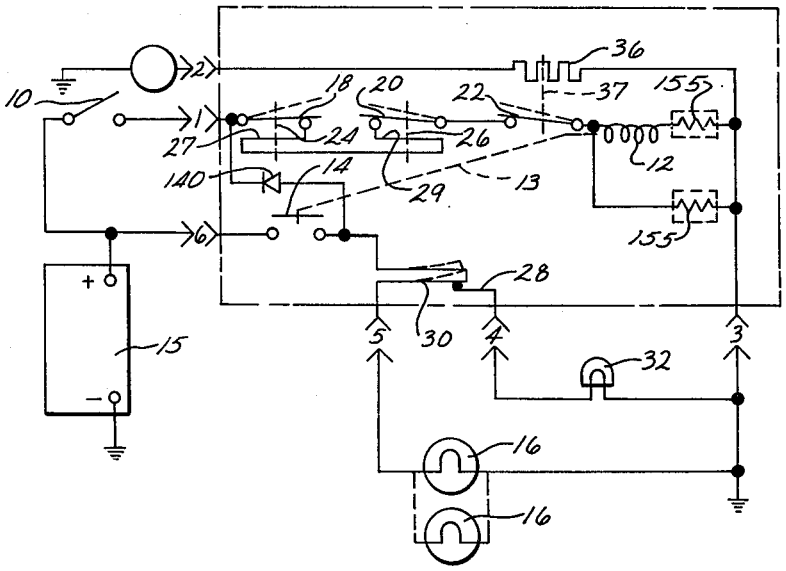
FIG. 1 is a schematic circuit diagram of the glow plug control circuit of the present invention.

Referring to the glow plug circuit as shown schematically in FIG. 1, an ignition switch 10 is closed when the ignition is turned on. This may be the key-operated switch generally used in automobiles. Closing of the switch completes a series circuit through the coil 12 of a power relay 13 to the negative or ground side of a battery 15. When the relay coil 12 is energized, a normally open power relay switch 14 is closed, completing a current path from the positive side of the battery 15 through a set of glow plugs 16 connected in parallel with each other to the negative side of the battery, thus completing a current path through the glow plugs causing the plugs to heat up. Three normally closed thermally actuated switches 18, 20 and 22 are connected in series with the ignition switch 10 and the relay coil 12 to complete the current path from the battery through the relay coil. If any one of these switches is opened, the power relay switch 14 is opened, interrupting the flow of current through the glow plugs 16. Switches 18 and 20 are thermally operated by a pair of controllers, indicated generally at 24 and 26, which are described in detail below in connection with FIGS. 2-4. The switches 18 and 20 are opened by thermal elements 27 and 29 which are heated by the flow of current through the relay coil 12. The heating and cooling rate of the thermal elements, as hereinafter described, are proportional to the heating and cooling rates of the glow plugs. Thus either one or both of the controllers function to cycle the glow plugs on and off at a rate which maintains the glow plugs at a closely regulated, substantially constant temperature. The two controllers 24 and 26 are substantially identical and, in terms of circuit operation, are redundant.

A thermally operated relay switch 28 has a resistance heater 30 connected in series with the glow plugs 16. The heater 30 is heated in response to the current flow through the glow plugs, and when it is heated to a predetermined temperature, the relay switch 28 is opened, breaking a current path from the positive side of the battery 15 through a WAIT/FAULT indicator light 32 to ground. The thermal relay switch 28 is designed, as hereinafter described, so that with full load current passing through the glow plugs, the switch 28 opens when the glow plugs have reached sufficient temperature to start the engine.

When the indicator light 32 goes off, it signals the driver to engage the starter and start cranking the engine. As the engine turns over, it drives an alternator 34 which provides a voltage across the heating element 36 of a thermal timer 37 to operate the normally closed switch 22. The thermal timer is normally designed to provide a one-minute delay between the time the alternator starts the flow of current through the heater element 36 and the time the timer switch 22 opens the circuit through the relay coil 12. This one-minute delay insures that ample time is allowed for the engine to start running before the power relay is de-energized and the glow plugs 16 are turned off.

In normal operation, the level of current through the glow plugs 16 is such that the relay switch 28 opens the circuit to the WAIT/FAULT light 32 before one of the controllers interrupts the flow of current through the glow plugs 16. As the glow plugs are cycled on and off by either of the controllers 24 or 26, the average current through the resistance heating element 30 of the relay switch 28 is sufficient to maintain the temperature of the thermal switch above the level at which the switch 28 is opened. Thus the light 32 stays off. However, if one or more of the parallel connected glow plugs 16 fails, the decrease in current through the heating element 30 does not permit the switch 28 to open before the power relay breaks the circuit. Thus the light 32 cycles off and on with the power relay, indicating a FAULT condition.

Figure 2:
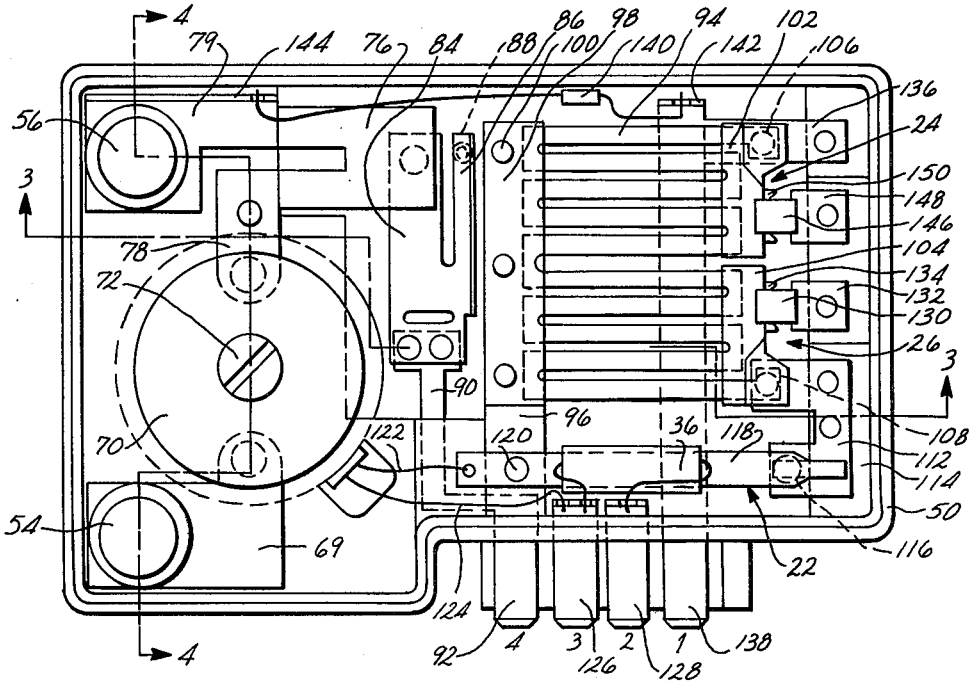
FIG. 2 is a top view of a glow plug control module incorporating features of the present invention.
Figure 3:
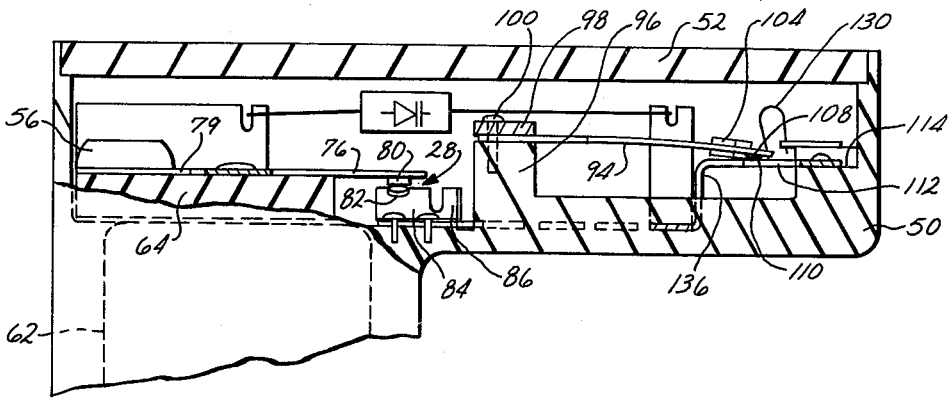
FIG. 3 is a side view, partially in section along the line 3—3 of the control module of FIG. 2.
Figure 4:
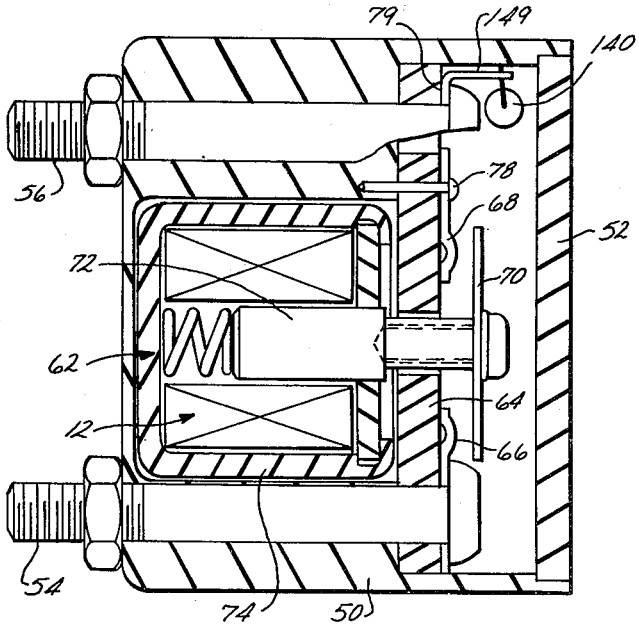
FIG. 4 is a cross-sectional view taken substantially on the line 4—4 of FIG. 2.

The controllers 24 and 26, the thermal timer 37, the power relay 12 and thermal relay switch 28 are preferably combined in a single glow plug control module shown in FIGS. 2-4. The module includes a molded plastic housing 50 and a plastic cover 52 forming the housing. A pair of power terminals in the form of bolts 54 and 56 extend out through openings in the housing. A power relay 62 has an insulator base 64 held in place by the terminal bolts 54 and 56. Fixed relay contacts 66 and 68 are secured to the surface of the mounting board 64. The contact 66 is part of a metal plate 69 in electrical contact with the terminal post 54. An electrical circuit is completed between the contacts 66 and 68 by a moving contact member 70 secured to the armature 72 of a relay solenoid 74. This solenoid includes the relay activating coil 12 (see FIG. 1.) for closing the normally open switch 14 formed by the fixed contact 66 and 68 and the moving contact 70. The terminal bolts 54 and 56 form the external connections 5 and 6 between the plus side of the battery and the glow plugs, as shown in FIG. 1.

The WAIT/FAULT thermal relay switch 28 with its thermal element 30 is shown in detail in FIGS. 2 and 3. The fixed contact 68 is connected to the terminal post 56 by a U-shaped bimetal conductor 76. One arm of the U-shaped conductor terminates in a conductive strip 78 including the contact 68. The other end terminates in a condutive strip 79 in electrical contact with the terminal post 56. Thus current passing between the terminals 5 and 6 through the power relay flows through the bimetal conductor 76 which forms the thermal element 30. Resistance heating of the bimetal conductor 76 raises its temperature, causing it to bend, actuating the switch 28. The switch 28 includes a moving contact 80 on the bimetal element and a fixed contact 82 on a conductive arm 84 secured at one end to the bottom surface of housing 50. The arm 84 is bifurcated to form rigid finger 86 that is adjusted in position by a calibration screw 88. A conductive strip 90 extends outside the housing to form the connector pin 92 for the external WAIT/FAULT light connection 4 as shown in FIG. 1.

The controllers 24 and 26 are constructed of a continuous serpentine-shaped strip of bimetal material 94. The strip 94 is clamped along one edge to a mounting lug 96 integrally formed on the inside of the housing 50 by a clamping member 98 which is pinned or screwed to the lug 96 by pins or screws 100. The opposite edge of the bimetal strip is embedded in a molded strip 102 to form the thermal element of the controller 24 and in a molded strip 104 to form the controller 26. Heating or cooling of the bimetal strip causes the molded strips 102 and 104 to be moved up and down as viewed in FIG. 3.

The bimetal strip 94 terminates at one end in a moving switch contact 106 and at the other end in a moving switch contact 108. The moving contact 108 moves into and out of contact with a fixed contact 110. The fixed contact 110 is supported on a terminal strip 112 which is pinned or otherwise secured to a horizontal surface 114 on the inside of the housing 50. The conductor strip 112 terminates at the other end in a fixed contact at 116 which forms one contact of the one-minute timer switch 22. The moving contact is secured to a bimetal strip 118 which is anchored at its other end to the lug 96 on the inside of the housing 50, as by a pin or screw 120. The bimetal strip 118 of the timer switch 22 is connected to the coil 12 of the power relay 62 through a lead 122. The other end of the coil is connected through a lead 124 to an output terminal 126 corresponding to the ground connection terminal 3 of FIG. 1. The resistance heater 36 is attached to the bimetal strip 118 to activate the timer. The heater is connected between the terminal 126 and a terminal 128, corresponding to the connection 2 of FIG. 1 going to the alternator.

The controller 26 is operated as a snap-action switch by virtue of an omega-shaped spring 130 compressed between a pivot member 132 pinned to the surface 114 and a pivot member 134 projecting from the molded strip 104 of the controller 26. The omega spring 130 provides an over center snap-action as the bimetal element 94 moves the pivot member 134 over center in relation to the pivot member 132.

Similarly, the controller 24 provides a switch connection between one end of the bimetal strip 94 through moving contact 106 and a fixed conductor strip 136 pinned to the surface 114 and joined with a terminal strip 138. A diode 140 is preferably connected between a binding post 142 at the end of the terminal strip 138 and a binding post 144 integral with the terminal strip 79. The diode is provided to suppress arcing of the power relay switch 14.

The controller 24 is provided with an over center switching action by means of an omega-spring 146 compressed between a fixed pivot member 148 secured to the housing, and a moving pivot member 150 secured to the molding strip 102 of the controller 24. Thus it will be seen that the two controllers 24 and 26 are substantially identical and use a common bimetal strip as the conductive path for the current energizing the solenoid coil 12 of the power relay. Heating of the bimetal strip 94 causes the circuit through the relay coil to be broken by either one or both of the controllers. The two controllers in series provide a redundancy that protects against damage to the glow plugs in the event that one or the other of the controllers fails to function, thus eliminating the need for a separate circuit breaker to protect the glow plugs.

It may be desirable to modify response time for the glow plugs to reach an engine starting temperature as a function of ambient temperature of the glow plug controller, depending on the starting characteristics of a particular engine design. For example, it may be required by a particular manufacturer to maintain the response time nearly constant over a wide range of ambient temperatures, with the response time dropping off sharply to zero at the higher ambient temperatures where the engine starts without the glow plugs. Other manufacturers may want the response time to drop off faster with a given temperature change at lower ambient temperatures and change only gradually to zero at the higher ambient condition. The response time versus ambient temperature can be tailored to any desired characteristic by providing a resistance element 155 in series and/or in shunt with the relay coil and bimetal resistance heaters of the controllers that has a non-linear temperature coefficient of resistance. For example, a thermistor may be used or the element 155. Thus, as the resistance of the element 155 changes with ambient temperature, the current through the heater elements 27 and 29 of the controllers varies, thereby changing the response time of the controllers.

What is claimed is:

1. A control for a diesel engine or the like for energizing a set of glow plugs when the engine is being started, comprising:

at least one controller including a temperature actuated switch having normally closed contacts that are opened with a rise in temperature, said temperature actuated switch including a bimetal element, the normally closed contacts being opened by movement of the bimetal element with increase in temperature above a predetermined level, the bimetal element and temperature actuated switch being connected electrically in series, current through the switch flowing through the bimetal element to produce resistance heating of the bimetal element to open the contacts, and a power relay connecting the set of glow plugs to an electrical power source and having a coil connected in series with the temperature actuated switch and the associated bimetal element across a current source, the temperature actuated switch, when opened, interrupting current flow through the bimetal element and the relay coil.

2. Apparatus of claim 1 further comprising an additional controller including a second temperature actuated switch having normally closed contacts that are opened with a rise in temperature, the second switch including a bimetal element connected electrically in series with the switch and bimetal element of the first mentioned controller and the relay coil.

3. Apparatus of claim 2 wherein said pair of controller switches have substantially identical thermal heating and cooling characteristics.

4. Apparatus of claim 3 wherein the heating and cooling rates of said thermal controller switches are substantially proportional respectively to the heating and cooling rates of said glow plugs.

5. Apparatus of claim 1 further including a thermal timer switch for interrrupting current to the glow plugs after a predetermined time interval after the glow plugs are initially energized.

6. Apparatus of claim 5 wherein the timer switch includes thermal timer means activated only when the engine is running.

7. Apparatus of claim 1 further including a delay start indicator, and a normally closed thermally actuated current responsive delay start switch responsive to current flow through the glow plugs, the switch connecting said indicator across the current source.

8. Apparatus of claim 7 wherein the delay start switch includes a bimetal switch actuating element connected to the current source by the power relay, whereby current to the indicator is interrupted by the power relay.

9. Apparatus of claim 7 wherein the delay start switch is activated to turn off the indicator before the controller switches interrupt current to the glow plugs.

10. Apparatus of claim 7 wherein the glow plugs are connected in parallel with each other, whereby failure of any of the glow plugs reduces the current through the bimetal of the thermal delay switch.

11. Apparatus of claim 1 further including a temperature sensitive impedance device connected in circuit with the controller for changing the amount of current passing through the bimetal element with change in ambient temperature.

* * * * *